US005141034A

United States Patent [19]

Sowers et al.

[11] Patent Number: 5,141,034

[45] Date of Patent: Aug. 25, 1992

[54] CHICKEN WIRE FENCE INTERWEAVING TOOL

[75] Inventors: William A. Sowers, Dale City; Gerald D. Van Antwerp, Fairfax County, both of Va.

[73] Assignee: The United States of America as represented by the Secretary of the Army, Washington, D.C.

[21] Appl. No.: 709,910

[22] Filed: May 24, 1991

[51] Int. Cl.[5] ..... B21F 15/04

[52] U.S. Cl. ..... 140/119

[58] Field of Search ..... 140/118, 119, 120, 122

[56] References Cited

U.S. PATENT DOCUMENTS 640,772 1/1900 Kauffman ..... 140/119
653,948 7/1900 Condon ..... 140/122
1,081,117 12/1913 Hoover .
1,637,226 7/1927 Lewis ..... 140/119
1,822,833 9/1931 Wilking ..... 140/119
1,890,213 12/1932 Cameron et al. ..... 140/119

*Primary Examiner*—Lowell A. Larson
*Attorney, Agent, or Firm*—Saul Elbaum; Jason M. Shapiro

[57] ABSTRACT

A hand tool for joining two lengths of a chicken wire fence or a plurality of parallel wires. The tool comprises a circular disk which is notched so as to accept a plurality of wires, and a ratcheting box end wrench which is notched in a similar manner. The disk is either welded to, or mechanically affixed, to the rotating sleeve of the wrench so that subsequent rotation of the disk by means of ratcheting will result in a joining of the engaged wires.

13 Claims, 2 Drawing Sheets

CHICKEN WIRE FENCE INTERWEAVING TOOL

GOVERNMENTAL INTEREST

The invention described herein may be manufactured, used and licensed by or for the U.S. Government for governmental purposes without the payment to us of any royalties thereon.

BACKGROUND OF THE INVENTION

Chicken wire fencing is a commonly used barrier because of its low cost and relatively simple installation. Generally, abutting sections of chicken wire fencing are joined in one of two ways. In the first method, a wire in each section of fencing is severed, and the two cut ends then twisted together either by hand or with a pair of pliers. The second method involves lacing the fencing material together with a separate piece of wire.

In situations where a great number of connections must be made, the process of joining lengths of chicken wire fencing can be time consuming. In addition, there is risk of personal injury from the sharp cut ends of the chicken wire.

Accordingly, the present invention relates to a device for joining chicken wire fencing in a rapid and safe manner. Other possible uses for the present invention include joining long parallel lengths of uncut wire and joining sections of chain link fencing and barbed wire.

SUMMARY OF THE INVENTION

The present invention relates to a hand tool for joining parallel lengths of wire, such as those found in abutting lengths of chicken wire fencing. A circular disk is provided with a notch which extends radially from the center of the disk. The notch root diameter is at least five thousanths of an inch greater than the diameter of the wires to be joined, but no more than twice the diameter of same. A conventional ratcheting box end wrench is provided with a slightly larger notch which extends radially from the center of the serrated sleeve normally used to engage a nut. The disk is connected to the sleeve in such a manner as to align both notches, so that the disk will rotate with the sleeve about the same axis.

In one embodiment of the present invention, the disk is also provided with two or more through holes located on opposing sides of the notch root and spaced in such a manner as to allow an equal number of machine screws to pass through the sleeve without interference. A flat plate is similarly provided with two or more tapped holes, having the same spacing as the holes in the notched disk. The plate is provided with a slightly larger notch than the disk. The plate and disk are placed against the sleeve so that their notches align, and the machine screws are passed through the disk and threaded into the plate, thereby connecting the notched disk to the sleeve by means of compression.

In another embodiment of the present invention, the disk is welded to the sleeve.

The present invention additionally provides for the disk to have a diameter which is less than the height of two cells of a chicken wire fence, but is greater than the diameter of the rotating sleeve.

The present invention further provides for the disk to have a thickness which is no less than half, but no more than three times, the diameter of the wires to be joined.

The present invention also provides for the disk to be fabricated of a material selected from the group consisting of carbon steel, nickel steel, and stainless steel.

It is an aspect of the invention, in accordance with the foregoing embodiments, to provide a method of joining two lengths of a chicken wire fence.

BRIEF DESCRIPTION OF THE DRAWINGS

The preferred embodiments of the present invention will be described with reference to the accompanying drawings.

DESCRIPTION OF THE PREFERRED EMBODIMENTS

Figure 1:
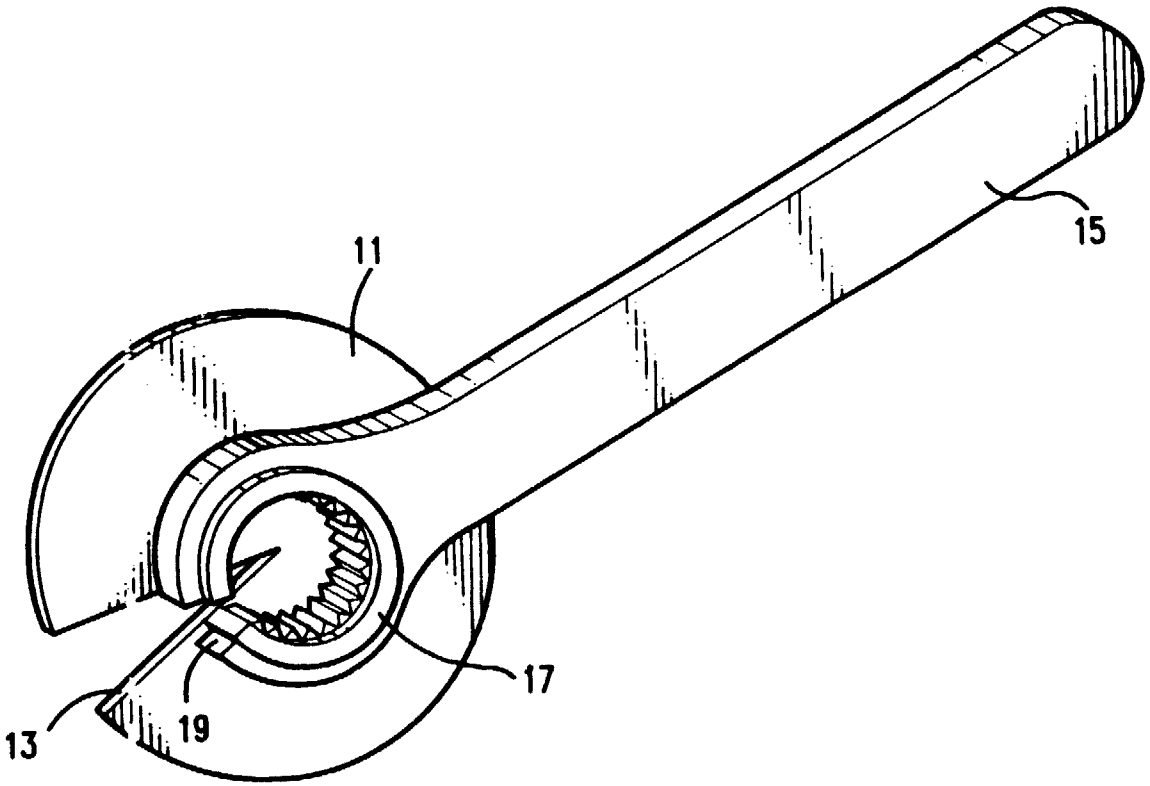
FIG. 1 is a perspective view of the chicken wire interweaving tool wherein the notched disk is permanently affixed to the ratcheting box end wrench.
Figure 2:
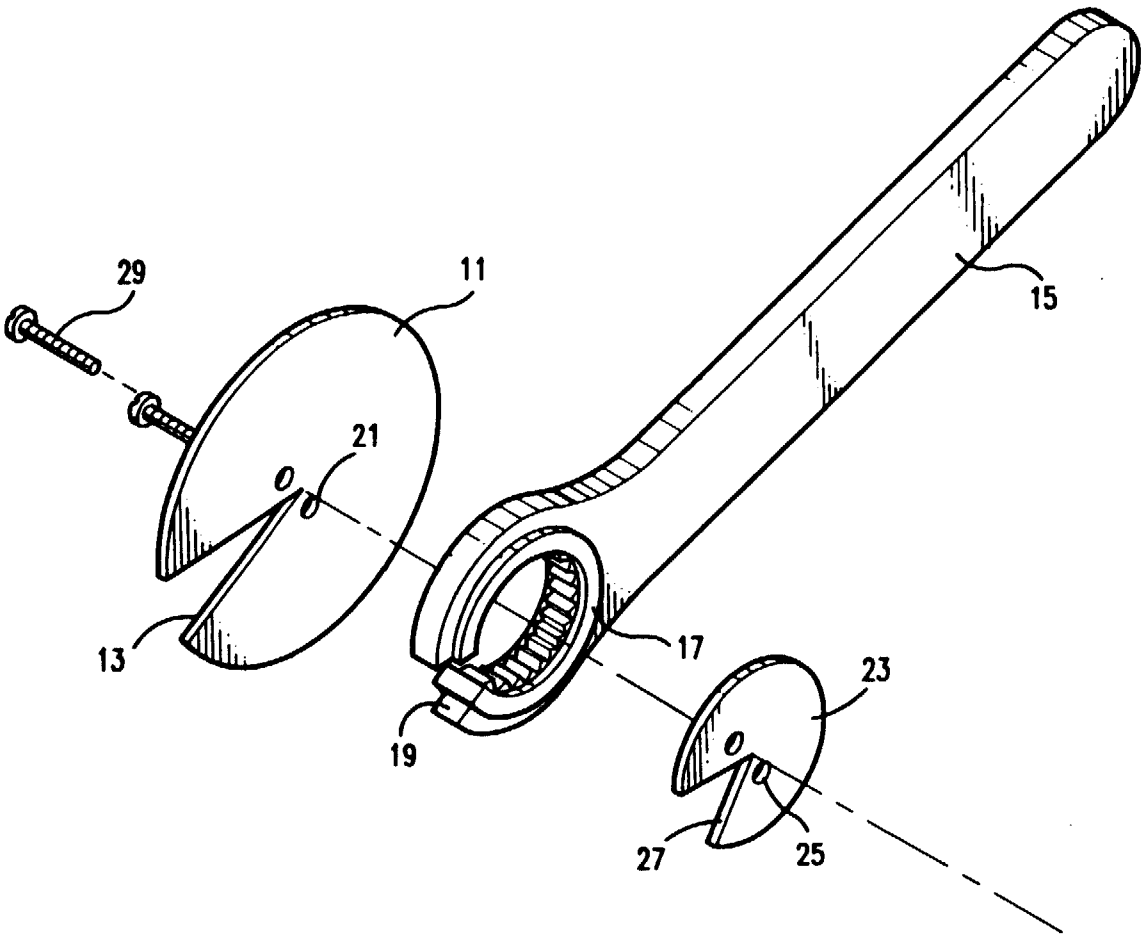
FIG. 2 is an exploded perspective view of the chicken wire interweaving tool wherein the notched disk is detachably affixed to the ratcheting box end wrench.

With reference to the attached drawings, two embodiments of the present invention are illustrated in FIGS. 1 and 2.

A circular disk 11, is provided with a notch 13 which extends radially from the center of the disk. The notch 13 may be a "V"-cut or a slot, however the root diameter should be at least 0.005 inches greater than the diameter of the wires to be joined. In any event, the notch root diameter should be no more than twice the diameter of said wires. For this reason, the preferred method of manufacture is to first drill a centrally located hole in the disk 11, and then to cut out the notch 13.

The diameter and thickness of the disk 11 are chosen according to the intended application. For instance, where lengths of chicken wire fencing having a cell size of 1 inch are to be joined, the diameter of the disk 11 should be less than 2 inches (the size of two cells). This allows the disk 11 to rotate freely while engaging the wires which form a common boundary for the adjacent cells.

The thickness of the disk 11 depends on both the wire material and the disk material. It should be chosen such that repeated use will not result in undue wear. Where the wire to be joined is galvanized steel, and the disk 11 is some type of steel (such as a carbon steel, nickel steel, or stainless steel), it is desirable for the disk 11 to have a thickness no less than one half, but no more than three times the diameter of the wire.

In a first embodiment of the present invention, illustrated in FIG. 1, the notched disk 11, is integrally connected to a ratcheting box end wrench 15 in such a manner as to allow rotation of the disk 11 about a common axis with the sleeve (or socket) 17 of the wrench 15. Where both the disk 11 and the wrench 15 are metallic, it is preferable to join the members by either continuous or spot welding techniques. Other possible methods include brazing (for metallics), and bonding (for either metallics or non-metallics).

The ratcheting box end wrench 15 is provided with a notch 19 oriented along the longitudinal axis of its handle, and extending radially from the center of the sleeve 17. The notch 19 should be larger than the corresponding notch 13 in the disk 11 to allow the wires to slide without interference into the notch root of the disk's notch 13. However, the notch 19 in the wrench 15 should not be so large as to significantly weaken, or affect the functionality of the ratcheting mechanism.

In a second embodiment of the present invention, illustrated in FIG. 2, the notched disk 11 is connected to the notched wrench 15 in a detachable manner, so as to allow use of the wrench 15 in a conventional manner as well.

The notched disk 11 is provided with two or more through holes 21, sized to accept an equivalent number of machine screws 29, and spaced to allow interference-free passage through the sleeve 17. A flat plate 23 is provided with correspondingly spaced, and sized, tapped holes 25, and an oversized notch 27. The disk 11 and the flat plate 23 are placed on opposite sides of the sleeve 17, and all notches 13, 19, 27 are aligned. A plurality of machine screws 29 are passed through the holes 21 in the disk 11, passed without interference through the sleeve 17, and threaded into the tapped holes 25 in the flat plate 23. The screws 29 are tightened to prevent slippage of the disk assembly during use.

In operation of the device in accordance with either embodiment, two lengths of chicken wire fencing are positioned side by side, or in an overlapping fashion, so that at least one pair of wires (comprising one wire from each length of fencing) are parallel and abutting. The interweaving tool is positioned so that the two wires slide into the notch 13 and are snugly located against the notch root. The tool is ratcheted by means of a repetitive arc-like hand motion while holding the handle of the wrench 15. (In some instances it may be necessary to manually turn the notched disk 11 until the ratcheting mechanism engages.) When the disk 11 has made no fewer than 2 revolutions the tool may be removed, and the fencing will be joined.

Similar joints may be fashioned in chain link fencing, barbed wire, or any parallel lengths of wire.

While there has been described and illustrated specific embodiments of the invention, it will be obvious that various changes, modifications and additions can be made herein without departing from the field of the invention which should be limited only by the scope of the appended claims.

We claim:

1. A hand tool comprising:

a circular disk, said disk having a V-notch which extends radially from the center of the disk, said V-notch having a root diameter at least five thousandths of an inch greater than the diameter of a given wire, but no more than twice the diameter of said wire, such that a plurality of such wires may fit into said V-notch;

a ratcheting box end wrench, said wrench comprising a handle, ratcheting mechanism, and serrated tubular sleeve, wherein said handle and said sleeve are V-notched, said V-notch extenting radially from the center of said sleeve, said V-notch further having dimensions greater than the V-notch in said disk;

wherein said disk is integrally connected to said sleeve in such a manner as to align said V-notches, such that said disk will rotate with said sleeve about the same axis;

whereby two lengths of chicken wire fence or a plurality of wires may be intertwined by placement within said V-notch and subsequent rotation of said disk by means of ratcheting.

2. The invention of claim 1 wherein said disk is provided with a plurality of through holes, said holes being located about the notch root and spaced in such a manner as to allow an equal number of machine screws to pass through said sleeve without interference;

said invention further comprising a flat plate, said plate provided with a notch and a plurality of tapped holes to receive said screws, said holes further having the same spacing as the holes in said disk;

wherein said disk and said plate are located on opposite ends of said sleeve;

whereby said disk may be connected to said sleeve by passing a plurality of machine screws through said through holes and threading said screws into said plate.

3. The invention of claim 1 wherein said disk has a diameter which is less than the height of two cells of a chicken wire fence, but is greater than the diameter of said sleeve, whereby said disk will fit between two cells and rotate freely.

4. The invention of claim 2 wherein said disk has a diameter which is less than the height of two cells of a chicken wire fence, but is greater than the diameter of said sleeve, whereby said disk will fit between two cells and rotate freely.

5. The invention of claims 1 or 3 wherein said disk has a thickness which is no less than one half, but no more than three times, the diameter of said wire.

6. The invention of claims 2 or 4 wherein said disk has a thickness which is no less than one half, but no more than three times, the diameter of said wire.

7. The invention of claims 1, 2, 3, or 4 wherein said disk is fabricated of a material selected from the group consisting of carbon steel, nickel steel, and stainless steel.

8. The invention of claim 5 wherein said disk is fabricated of a material selected from the group consisting of carbon steel, nickel steel, and stainless steel.

9. The invention of claim 6 wherein said disk is fabricated of a material selected from the group consisting of carbon steel, nickel steel, and stainless steel.

10. The invention of claims 1 or 3 wherein said disk is welded to said sleeve.

11. The invention of claim 5 wherein said disk is welded to said sleeve.

12. The invention of claim 7 wherein said disk is welded to said sleeve.

13. A method of joining two lengths of a chicken wire fence, said method comprising the steps of:

(a) positioning two lengths of chicken wire fencing side by side, or in an overlapping fashion, such that at least one pair of wires, comprising one wire from each length of fencing, are parallel and abutting;

(b) placing said wires from each length of fencing into a disk provided with a V-notch, said notch extending radially from the center of said disk and having a notch root diameter no less than five thousandths of an inch greater than the diameter of said wire, but no more than twice the diameter of same;

wherein said disk is integrally connected to the rotating sleeve of a ratcheting box end wrench, said wrench comprising a handle, ratcheting mechanism, and serrated sleeve, said sleeve being provided with a larger notch than said disk to prevent interference;

(c) rotating said disk by means of a repetitive arc-like hand motion which causes the ratchet to engage in the direction of twist, said rotating to stop after no less than two revolutions of said disk have occurred.

* * * * *